US006652327B2

(12) United States Patent
Lau et al.

(10) Patent No.: US 6,652,327 B2
(45) Date of Patent: Nov. 25, 2003

(54) TERMINAL/PIN BLOCK FOR MULTIPIN ELECTRONIC PLUG

(75) Inventors: Thorsten Lau, Meinerzhagen (DE); Gert Krah, Kirchen (DE); Heinz Sonntag, Zirndorf (DE)

(73) Assignee: Elco Europe GmbH, Betzdorf (DE)

( * ) Notice: Subject to any disclaimer, the term of this patent is extended or adjusted under 35 U.S.C. 154(b) by 0 days.

(21) Appl. No.: 10/125,683

(22) Filed: Apr. 18, 2002

(65) Prior Publication Data

US 2002/0155762 A1 Oct. 24, 2002

(30) Foreign Application Priority Data

Apr. 19, 2001 (DE) ..... 101 19 412

(51) Int. Cl.[7] ..... H01R 9/22

(52) U.S. Cl. ..... 439/717; 439/701; 439/594

(58) Field of Search ..... 439/701, 717, 439/594, 608, 609

(56) References Cited

U.S. PATENT DOCUMENTS

| | | | | |
|---|---|---|---|---|
| 3,273,107 A | * | 9/1966 | Chandler | 439/717 |
| 4,580,861 A | * | 4/1986 | Kaley | 439/594 |
| 5,961,355 A | * | 10/1999 | Morlion et al. | 439/686 |
| 6,409,543 B1 | * | 6/2002 | Astbury, Jr. et al. | 439/608 |

* cited by examiner

*Primary Examiner*—Tho D. Ta
*Assistant Examiner*—Larisa Tsukerman
(74) *Attorney, Agent, or Firm*—Herbert Dubno; Andrew Wilford

(57) ABSTRACT

A terminal/pin block for making a multipin electronic plug has a rigid dielectric plate lying in a plane and having a pair of edges and two opposite faces. Respective centering formations formed on the faces project away from the plane and the centering formations of one of the faces are complementary to and fittable in the centering formations of the other of the faces. A row of conductive strips imbedded in the plate all lie in a common plane parallel to each other and each have one end forming a contact pin and an opposite end forming a terminal. The contact pins all extend from one of the edges of the plate and the terminals all extend from another of the plate edges.

3 Claims, 2 Drawing Sheets

TERMINAL/PIN BLOCK FOR MULTIPIN ELECTRONIC PLUG

FIELD OF THE INVENTION

The present invention relates to a multipin electronic plug of the type used, for instance, on a computer-printer cable. More particularly this invention concerns a block that carries a single row of pins associated with respective terminals and that is used in the manufacture of such a plug.

BACKGROUND OF THE INVENTION

A standard multipin electronic plug has a body with several rows of pins that fit into respective conductive holes of a complementary socket. Each pin is associated with a respective terminal to which a wire or printed-terminal contact is soldered. Two rows of terminals are normally used, although a greater number of rows is employed in special situations.

The basic element for making such a multipin electronic plug is a terminal/pin block having a rigid dielectric plate lying in a plane and having a pair of edges and two opposite faces and a row of conductive strips imbedded in the plate. The strips all lie in a common plane parallel to each other and each have one end forming a contact pin and an opposite end forming a terminal. The contact pins all extend from one of the edges of the plate and the terminals all extend from the other of the plate edges. Each pin end is slim and of uniform shape and section, and each terminal end often has a wire- or solder-holding split. The strips may be straight or nonstraight, for instance L-shaped, when the terminals project crosswise to the pins.

Such a terminal/pin block is made by first stamping out of sheet metal the row of conductive strips with flashing left between them to maintain their spacing. This stamped-out part is then cast into a plastic plate from which the terminal and pin ends project, the flashing being provided at the projecting portions. Then the flashing is punched out, leaving the strips fixed in the plate but electrically isolated from each other.

To make the multipin plug, at least two such terminal/pin blocks are encased in a mold and positioned therein such that the pins and terminals are at the desired orientation relative to one another. Then more plastic is injected in to form around the plates a larger plastic body from one edge of which projects several rows of pin ends and from another edge of which project several rows of terminal ends.

The problem with this style of manufacture is that the terminal/pin blocks often shift during the final molding operation so that the pins become misaligned and cannot fit a standard plug. This misalignment is normally caused by the high pressure of the plastic injected in a high-speed operation into the final mold so that, even if the blocks are perfectly positioned as the mold is closed, the incoming resin displaces them during the molding operation.

OBJECTS OF THE INVENTION

It is therefore an object of the present invention to provide an improved terminal/pin block for a multipin electronic plug.

Another object is the provision of such an improved terminal/pin block for a multipin electronic plug which overcomes the above-given disadvantages, that is which can be manufactured at high speed without producing misaligned contact pins.

A further object is to provide an improved method of making a multipin electronic plug.

SUMMARY OF THE INVENTION

A terminal/pin block for making a multipin electronic plug has a rigid dielectric plate lying in a plane and having a pair of edges and two opposite faces. According to the invention respective centering formations formed on the faces project away from the plane and the centering formations of one of the faces are complementary to and fittable in the centering formations of the other of the faces. A row of conductive strips imbedded in the plate all lie in a common plane parallel to each other and each have one end forming a contact pin and an opposite end forming a terminal. The contact pins all extend from one of the edges of the plate and the terminals all extend from another of the plate edges.

The method of this invention therefore involves the steps of embedding in the above-defined rigid dielectric plate the row of conductive strips with the strips all lying in the plane parallel to each other and with the pins extending from one plate edge and the terminals from the other. Each of the faces of the plate is formed with at least one respective centering formation projecting away from the plane with the centering formations of one of the faces complementary to and fittable in the centering formation of the other of the faces. A plurality of the plates are stacked with the pins extending parallel to each other and the formations of adjacent plates interfitting and impeding movement of the plates relative to each other parallel to the plane. Then the stacked plates are enclosed in a mold cavity with the pins and terminals outside the mold cavity, and the mold cavity is filled around the plates with a molten dielectric plastic that is hardened into a plug body.

The centering formations according to the invention prevent any shifting of the blocks during the molding operation. Thus in the finished product the pins and terminals will be perfectly positioned.

According to the invention the plate is generally square and has four corners and the formations are at the corners. Furthermore the formations of the other face are formed as seats into which the centering formations of the one face can fit for stacking of the blocks. These formations have planar outer end faces extending parallel to the plane.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 2:
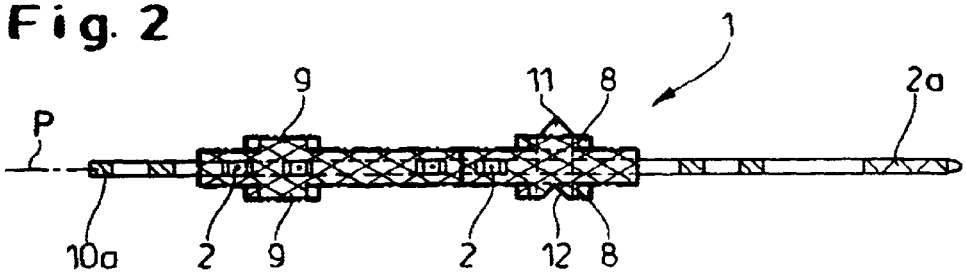
FIG. 2 is a section taken along line II—II of FIG. 1.
Figure 1:
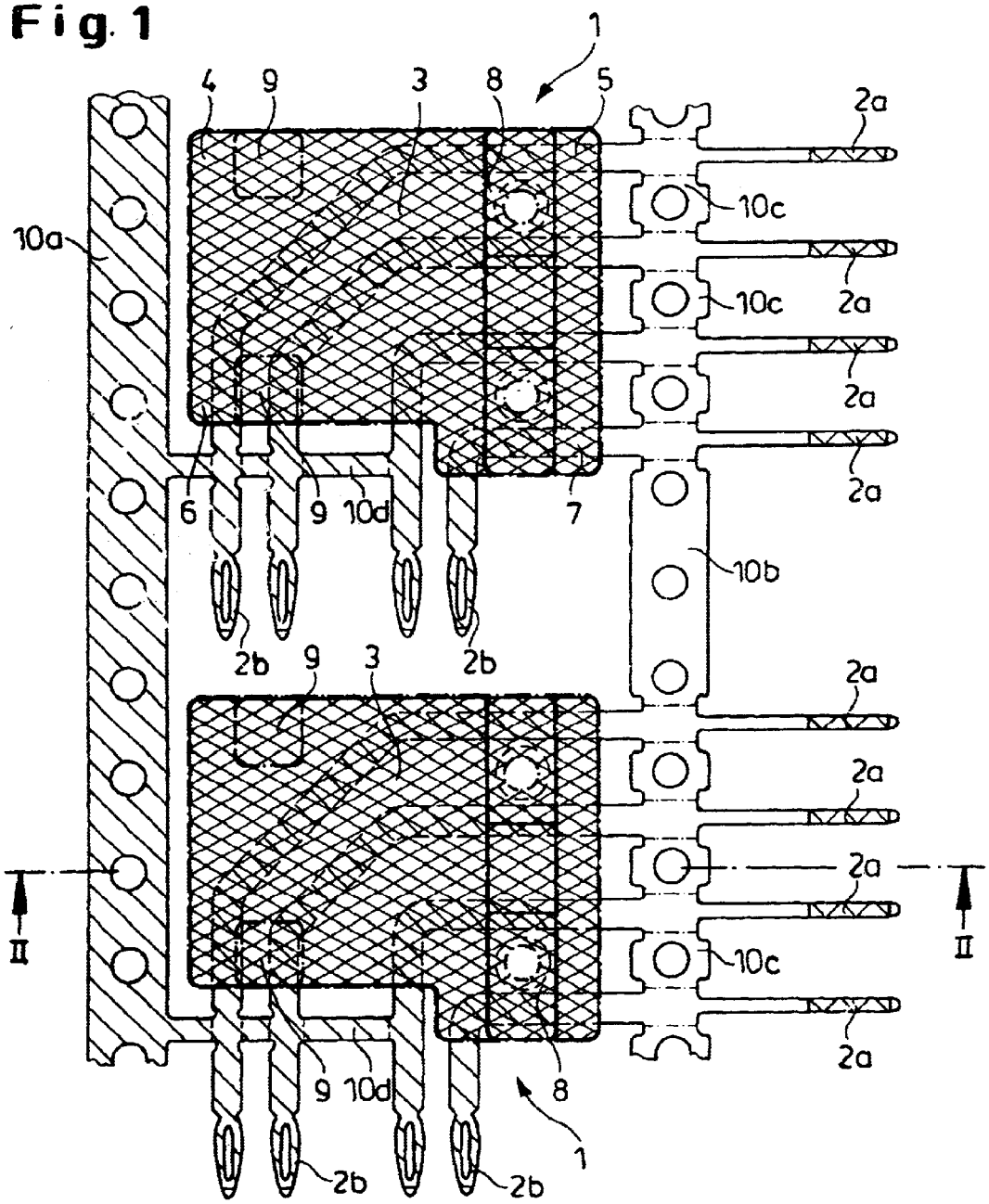
FIG. 1 is a top view of the terminal/pin block according to the invention.

As seen in FIGS. 1 and 2, terminal/pin blocks 1 are made according to the invention by stamping from conductive sheet metal rows of L-shaped conductive strips 7 each having one end forming a contact pin 2*a* and an opposite end forming a terminal 2*b*. The pins 2*a* extend parallel to one another in a plane P and the terminals 2*b* extend at a right angle to the pins 2*a*, but also parallel to one another and in the same plane P. Initially flashing 10*c* interconnects the pins 2*a* of each block 1, flashing 10*b* connects the pins 2*a* of one block 1 with the pins 2*a* of the adjacent block 1, flashing 10*d* interconnects the terminals 2*b* of each block 1 and flashing 10*a* connects the flashing 10*d* of each block 1 with the flashing 10*d* of adjacent block(s) 1.

A generally square plate 3 of dielectric plastic is cast around the row of conductive strips 7 for each block 1, with the pins 2*a*, terminals 2*b*, and all the flashing 10*a*, 10*b*, 10*c*, and 10*d*, outside the edges of the plates 3. There is no electrical contact between adjacent strips 7 inside each plastic plate 3.

According to the invention each plate 3 has four corners 4, 5, 6, and 7. A rectangular-section bar 8 is formed on each face of each plate 3, projecting perpendicular to the plane P and extending generally between the corners 5 and 7 and parallel to the edge extending between these corners 5 and 7 and from which the pins 2*a* project. The bar 8 on one face is formed with a pair of upstanding conical centering formations or bumps 11 and the bar 8 on the opposite face is formed with a pair of complementary conical centering formations or seats 12. In addition near each corner 4 and 6, each plate 3 is formed on each face with a pair of square bumps 9 of the same height as the respective bars 8 so that the outer faces of the bars 8 and bumps 9 on the faces of each plate 3 lie on planes symmetrically flanking and parallel to the plane P.

Figure 3:
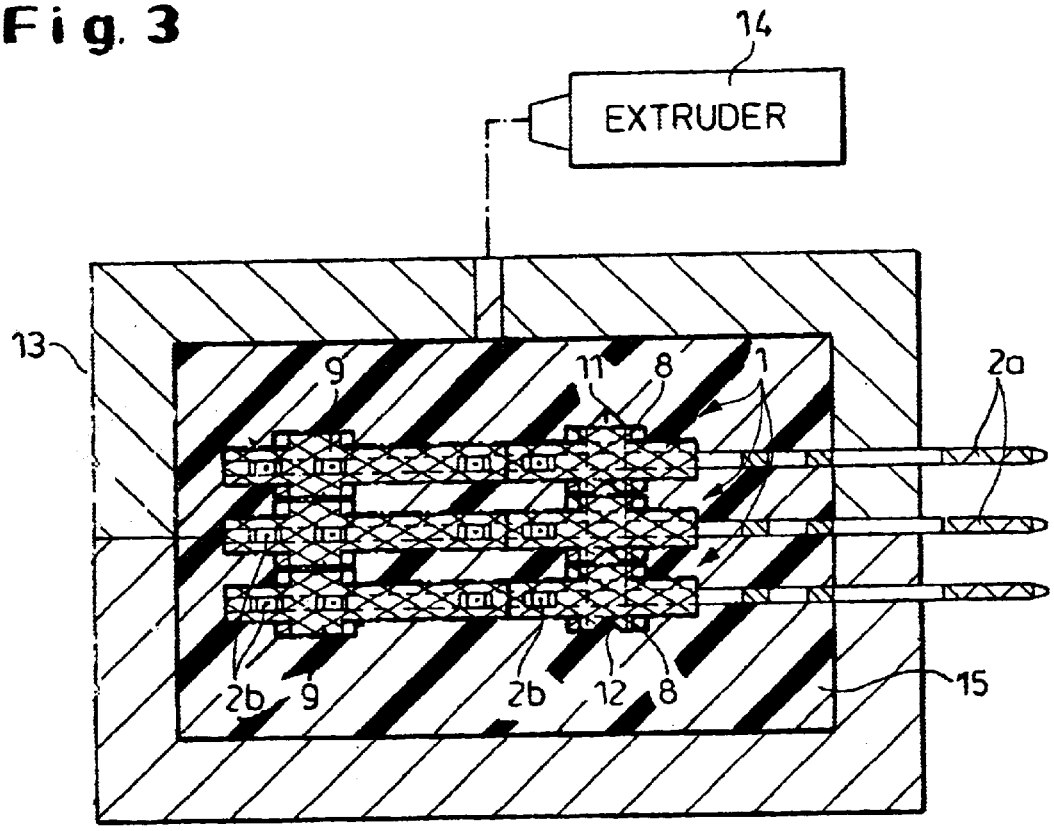
FIG. 3 is a largely schematic view illustrating the method of this invention.

In order to fashion the blocks 1 into a multipin electronic plug, after the plates 1 have cured all the flashing 10*a*, 10*b*, and 10*d* is punched out to leave the conductors 7 of each plate 3 insulated from each other and to separate the blocks 1 from one another. Then as shown in FIG. 3 the blocks 1 are stacked up directly atop one another with the bumps 11 of each block 1 engaging in the seats 12 of the adjacent block 1. This interfit ensures that they blocks 1 remain exactly positioned relative to each other. The same effect could be achieved by formations 8 and 9 of different shape, for instance as a pin and socket or groove and ridge.

This stack is then enclosed in a cavity of a mold 13 with the pins 2*a* and terminals 2*b* projecting from the mold 13. An extruder 14 pressurizes the mold 13 around the blocks 1 with molten resin 15. After this resin 15 cures, the plug is demolded. Since the plates 3 are prevented from shifting parallel to each other by the engagement of the bumps 11 in the seats 12, the pins 2*a* will be perfectly positioned. Since the raised centering formations 8 and 9 do not occupy or constitute the entire faces of the plates 3, the incoming resin can flow between adjacent plates 3 and form a solid matrix for them.

It is possible to sandwich plates 3 without conductive strips 7 between adjacent plates 3 having such strips 7 in order to make a blank row, or to clip off the pins 2*a* and terminals 2*b* for the same effect.

We claim:

1. A terminal/pin block for making a multipin electronic plug, the block comprising:

a rigid dielectric plate lying in a plane and having a pair of edges and two opposite plate faces;

a plurality of raised centering formations formed on each of the plate faces, projecting away from the plane, and each having an end face substantially parallel to the plane, the centering formations of one of the plate faces being formed on the respective end face with bumps projecting away from the plane, the centering formations of the other of the plate faces being formed with seats complementary to the bumps of the centering formations of the centering formations of the one plate face, the centering formations being oriented on the respective plate faces such that two of the plates can be stacked with the end faces of the centering formations of the one face of one of the plates bearing on the end faces of the other face of the other of the plates, the bumps of the centering formations of the one face of the one plate fitting complementarily into the seats of the centering formations of the other plate face of the other plate, and the one plate face of the one plate spaced from the other plate face of the other plate except at the centering formations; and a row of conductive strips imbedded in the plate, all lying in a common plane parallel to each other, and each having one end forming a contact pin and an opposite end forming a terminal, the contact pins all extending from one of the edges of the plate and the terminals all extending from the other of the plate edges.

2. The terminal/pin block defined in claim 1 wherein the plate is generally square and has four corners, the formations being at the corners.

3. A method of making a multipin plug, the method comprising the steps of:

embedding in a plurality of a rigid and identical dielectric plates each lying in a plane and having a pair of edges and two opposite plate faces a respective row of conductive strips with the strips all lying in the respective plane parallel to each other and each having one end forming a contact pin projecting from one of the edges of the respective plate and an opposite end forming a terminal extending from the other of the edges of the respective plate;

forming on each of the plate faces of each of the plates a respective plurality of raised centering formations projecting away from the respective plane and each having an end face substantially parallel to the respective plane;

forming respective bumps on the end faces of the centering formations of one of the plate faces of each of the plates and respective seats on the end faces of the centering formations of the other of the plate faces of each of the plates, the bumps being complementary to the seats;

stacking the plurality of plates with the pins extending parallel to each other, the end faces of confronting plate faces bearing on each other and holding the plates out of contact with each other except at the end faces, and the bumps and seats of adjacent plates interfitting and impeding movement of the plates relative to each other parallel to the respective planes;

enclosing the stacked plates in a mold cavity with the pins and terminals outside the mold cavity; and filling the mold cavity around and between the plates with a molten dielectric plastic and hardening the plastic around and between the plates into a plug body.

* * * * *